United States Patent [19]

Tanaka et al.

[11] 4,436,060

[45] Mar. 13, 1984

[54] ENGINE COOLING SYSTEM

[75] Inventors: Toshiaki Tanaka, Fujisawa; Shoji Ushimura, Yokosuka; Yukihiro Etoh, Yokohama, all of Japan

[73] Assignee: Nissan Motor Company, Ltd., Yokohama, Japan

[21] Appl. No.: 229,103

[22] Filed: Jan. 28, 1981

[30] Foreign Application Priority Data

Feb. 1, 1980 [JP] Japan ..... 55-11280[U]

[51] Int. Cl.³ ..... F01P 7/16

[52] U.S. Cl. ..... 123/41.1; 123/41.44; 123/198 F

[58] Field of Search ..... 123/41.08, 41.09, 41.1, 123/41.74, 198 F, 41.02, 41.44, 41.51

[56] References Cited

U.S. PATENT DOCUMENTS

| | | | |
|---|---|---|---|
| 1,862,723 | 6/1932 | Summers | 123/41.44 |
| 2,735,415 | 2/1956 | Slonek | 123/41.74 X |
| 3,805,748 | 4/1974 | Garcea et al. | 123/41.1 |
| 3,851,629 | 12/1974 | Mayr et al. | 123/41.09 X |
| 4,096,845 | 6/1978 | Holmes | 123/198 F |
| 4,150,651 | 4/1979 | Wade et al. | 123/198 F X |
| 4,200,083 | 4/1980 | Ishida | 123/198 F |
| 4,249,374 | 2/1981 | Sugasawa et al. | 123/198 F |

FOREIGN PATENT DOCUMENTS

| | | |
|---|---|---|
| 386203 | 12/1923 | Fed. Rep. of Germany . |
| 874385 | 4/1953 | Fed. Rep. of Germany . |
| 2900953 | 7/1979 | Fed. Rep. of Germany . |
| 52-135903 | 11/1977 | Japan . |

*Primary Examiner*—William A. Cuchlinski, Jr.

*Attorney, Agent, or Firm*—Schwartz, Jeffery, Schwaab, Mack, Blumenthal & Koch

[57] ABSTRACT

An engine cooling system is disclosed for use with an internal combustion engine including first and second engine banks arranged with a V-angle, first and second cylinder units arranged in the first and second engine banks, respectively, the second cylinder unit being disabled under low load conditions. An engine coolant is circulated from a radiator through a cooling jacket disposed in the first engine bank to a cooling jacket disposed in the second engine bank and hence to the radiator.

3 Claims, 2 Drawing Figures

ENGINE COOLING SYSTEM

BACKGROUND OF THE INVENTION

1. Field of the Invention

This invention relates to a V-type split internal combustion engine operable on less than all of its cylinders when the engine load is below a given value and, more particularly, to an engine cooling system for use with such an engine.

2. Description of the Prior Art

It is known and desirable to increase the efficiency of a multicylinder internal combustion engine by reducing the number of cylinders on which the engine operates under predetermined engine operating conditions, particularly conditions of low engine load. For this purpose, control means has been provided which disables a number of cylinders in a multicylinder internal combustion engine by suppressing the supply of fuel to certain cylinders or by preventing the operation of the intake and exhaust valves of selected cylinders under low load conditions. The disablement of some of the cylinders of the engine increases the load on those remaining in operation and, as a result, the energy conversion efficiency is increased.

One difficulty with such a split internal combustion engine is the tendency toward an excessive reduction in the temperature of the cylinders disabled during a split engine mode of operation, causing unstable combustion therein when the engine operation is changed to its full engine mode and eventually misfiring therein particularly when the engine is accelerated after a relatively long period of a split engine mode of operation.

The present invention provides an engine cooling system for use in a V-type split internal combustion engine which can overcome any tendency toward an excessive reduction in the temperature of the cylinders disabled during a split engine mode of operation.

SUMMARY OF THE INVENTION

The present invention provides an engine cooling system for use with an internal combustion engine including first and second engine banks arranged with a V-angle, first and second cylinder units each including at least one cylinder, the first and second cylinder units arranged in the first and second engine blocks, respectively, the second cylinder unit being disabled under low load conditions. The cooling system comprises a radiator, first and second cooling jackets disposed in the first and second engine banks, respectively. The first and second cooling jackets are connected in series with each other. A feed pump is provided for drawing an engine coolant from the radiator and circulating it through the first cooling jacket to the second cooling jacket and hence through a return passage to the radiator. Accordingly, the second cooling jacket is supplied with the engine coolant, which is warmed when passing through the first cooling jacket, to keep the second engine bank warmed.

Preferably, the return passage is connected to the feed pump through a passage bypassing the radiator. The return passage has a temperature sensitive valve means located downstream of the bypass passage for blocking the flow of the engine coolant to the radiator and permitting the engine coolant flow to the feed pump when the engine coolant temperature falls below a predetermined value. At low engine temperatures, the engine coolant is circulated through the first and second cooling jackets without passing through the radiator. Accordingly, the engine coolant temperature is held at a higher value.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENT

Figure 1:
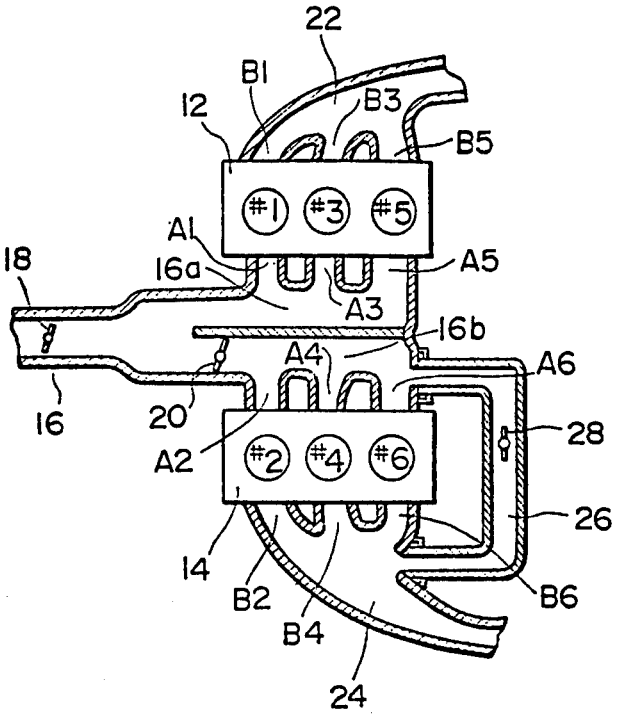
FIG. 1 is a schematic sectional view showing one embodiment of a V-type split internal combustion engine made in accordance with the present invention.

Referring now to FIG. 1, there is illustrated one embodiment of a V-type split internal combustion engine made in accordance with the present invention. The engine is shown as a V-six split engine having first and second engine banks 12 and 14 arranged with a V-angle. The first engine bank 12 contains three cylinders #1, #3 and #5 being always active during engine operation. The second engine bank 14 contains three cylinders #2, #4 and #6 being inactive when the engine load is below a predetermined value.

An air induction passage 16 extends between the first and second engine banks 12 and 14. The induction passage 16 has therein a throttle valve 18 and has first and second intake passages **16*a* and 16*b* divided therefrom downstream of the throttle valve 18. The first intake passage 16*a* extends near the first engine bank 12 and leads to the cylinders #1, #3 and #5 through respective branches A1, A3 and A5 extending without crossing each other. The second intake passage 16*b* extends near the second engine bank 14 and leads to the cylinders #2, #4 and #6 through respective branches A2, A4 and A6 extending without crossing each other. This arrangement is effective to simplify the structure of the intake system including the induction passage 16, first and second intake passages 16*a* and 16*b*, and branches A1 to A6**.

Fuel to the cylinders #1 and #6 is supplied through respective fuel injection valves (not shown). When the engine load falls below a predetermined value, the fuel injection valves associated with the cylinders #2, #4 and #6 stop operation to block the supply of fuel to the cylinders #2, #4 and #6 so as to change the engine operation into a split mode where the engine operates only on the remaining cylinders #1, #3 and #5.

The second intake passage **16*b* has at its entrance a stop valve 20 adapted to close to block the flow of fresh air to the cylinders #2, #4 and #6** during a split engine mode of operation.

The engine also has first and second exhaust passages 22 and 24 separated from each other. The first exhaust passage 22 extends outwardly of the first engine bank 12 and leads from the cylinders #1, #3 and #5 through respective branches B1, B3 and B5 extending without intersecting each other. The second exhaust passage 24 extends outwardly of the second engine bank 14 and leads from the cylinders #2, #4 and #6 through respective branches B2, B4 and B6 extending without intersecting each other. This arrangement is effective to simplify the structure of the exhaust system including the first and second exhaust passages 22 and 24 and branches B1 to B6.

The second exhaust passage 24 is connected to the second intake passage **16*b* through an exhaust gas recirculation (EGR) passage 26 having therein an EGR valve 28. The EGR valve 28 is adapted to open to permit exhaust gases to recirculate through the EGR passage 26 into the second intake passage 16*b* so as to minimize pumping losses in the inactive cylinders #2, #4 and #6 during a split engine mode of operation. The EGR valve 28 closes to prevent exhaust gas recirculation during a full engine mode of operation where the engine operates on all of the cylinders #1 to #6**.

The sequence or order of firing of the V-type split engine is as follows: Cylinders #1, #2, #3, #4, #5 and #6. That is, explosions occur at constant intervals of 240° of crankshaft rotation during a split engine mode of operation where the engine operates only on the cylinders #1, #3 and #5. Accordingly, the engine can operate with good dynamic balance.

Figure 2:
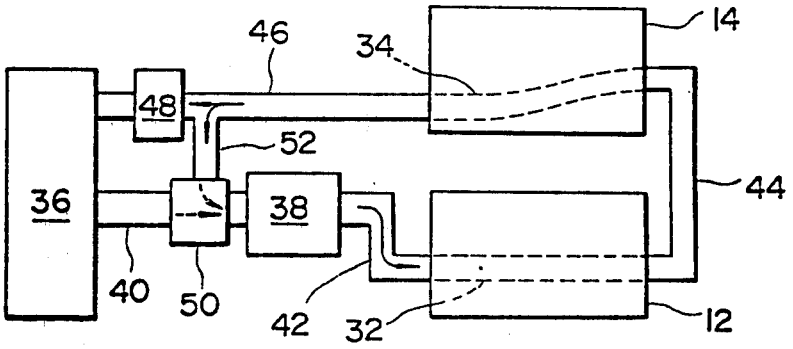
FIG. 2 is a schematic diagram showing an engine cooling system for use with the engine of FIG. 1.

As shown in FIG. 2, the first engine bank 12 has a first cooling jacket 32 disposed therein, and the second engine bank 14 has a second cooling jacket 34 disposed therein. A feed pump 38 is provided which has its one side connected through a conduit 40 to the outlet of a radiator 36 for drawing an engine coolant therefrom. The discharge side of the pump 38 is connected through a conduit 42 to the first cooling jacket 32, which in turn is connected through a conduit 44 to the second cooling jacket 34 and hence through a conduit 46 to the inlet of the radiator 36 which dissipates the heat from the engine coolant.

The conduit 46 has therein a thermostat valve 48 which opens at high temperatures. The thermostat valve 48 closes when the engine coolant temperature falls below a predetermined value. The conduit 40 is provided therein with a three-way solenoid valve 50. The three-way valve 50 has a first port connected to the outlet of the radiator 36, a second port connected through a conduit 52 to the conduit 46 somewhere upstream of the thermostat valve 48. The three-way valve 50 is sensitive to engine coolant temperature for providing communication between the first and third ports to connect the outlet of the radiator 36 to the feed pump 38 at high temperatures. When the engine coolant temperature falls below a predetermined value, the three-way valve 50 provides communication between its second and third ports to connect the conduit 52 to the pump 38.

When the engine coolant temperature is relatively high such as during a full engine mode of operation, the thermostat valve 48 opens and the three-way valve 50 provides communication between its first and third ports. Thus, the feed pump 38 draws the engine coolant from the radiator 36 and circulates it through the first and second cooling jackets 32 and 34 to the radiator 36, thereby cooling the first and second engine banks 12 and 14. The radiator 36 dissipates the heat from the circulated engine coolant.

During a split engine mode of operation where the cylinders #2, #4 and #6 contained in the second engine bank 14 are disabled, the temperature of the second engine bank 14 falls. On the other hand, the second cooling jacket 34 is supplied with the engine coolant warmed when passing through the first cooling jacket 32 associated with the first engine bank 12 containing the cylinders #1, #3 and #5 remaining in operation so as to keep the second engine bank 14 warm. As a result, the cylinders #2, #4 and #6 can start stable combustion immediately when the engine operation is shifted from its split engine mode into a full engine mode. This is effective to improve engine acceleration and exhaust gas purifying performance just after the engine operation is changed from its split engine mode to a full engine mode.

If the engine coolant temperature falls below a predetermined value, the thermostat valve 48 closes and the three-way valve 50 provides communication between its second and third ports. Thus, the engine coolant flowing through the first and second cooling jackets 32 and 34 is not returned to the radiator 36, but introduced to the feed pump 38 through the conduit 52. As a result, the temperature of the engine coolant increases and the second engine bank 34 is kept warmed. This is effective to prevent any excessive reduction in the temperature of the cylinders disabled during a split engine mode of operation.

It will be apparent from the foregoing that with the arrangement of the present invention, high engine acceleration and exhaust gas purifying performance can be achieved just after a relatively long period of a split engine mode of operation.

While the present invention has been described in connection with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A V-type internal combustion engine comprising:

(a) first and second engine blocks arranged with a V-angle;

(b) first and second cylinder units each including at least one cylinder, said first and second cylinder units being arranged in said first and second engine blocks, respectively;

(c) means for disabling said second cylinder unit under low load conditions; and (d) a coolant circuit including:

a first jacket disposed in said first engine block, said first jacket adapted to receive an engine coolant for cooling said first cylinder unit;

a second jacket disposed in said second engine block, said second jacket adapted to receive an engine coolant for cooling said second cylinder unit, said second jacket communicating in series with said first jacket;

a radiator connected through a first passage to said first jacket and connected through a second passage to said second jacket; and a feed pump for circulating an engine coolant through said coolant circuit in a direction from said first jacket to said second jacket such that the second cylinder unit is maintained at a temperature sufficient to permit rapid combustion when said second cylinder unit is enabled after being disabled.

2. The internal combustion engine of claim 1, wherein said coolant circuit further comprises a bypass passage connecting said first and second passages, and means operable in response to an engine coolant temperature for preventing the engine coolant from flowing through said radiator and for permitting the same to flow through said bypass passage to said first jacket when the engine coolant temperature falls below a predetermined value.

3. The internal combustion engine of claim 2, wherein said means comprises:

a first valve disposed in said second passage at a position downstream of said bypass passage for closing only when the engine coolant temperature is below the predetermined value; and a second valve operable between a first position communicating said first jacket with said radiator and a second position communicating said first jacket with said bypass passage, said second valve adapted to change from said first position to said second position when the engine coolant temperature is below the predetermined value.

* * * * *